United States Patent [19]

Rhotert

[11] 4,166,029

[45] Aug. 28, 1979

[54] APPARATUS FOR SORTING OBJECTS

[75] Inventor: Bernhard Rhotert, Laggenbeck, Fed. Rep. of Germany

[73] Assignee: C. Keller GmbH u. Co. KG., Ibbenbüren, Fed. Rep. of Germany

[21] Appl. No.: 823,243

[22] Filed: Aug. 10, 1977

[30] Foreign Application Priority Data

Aug. 19, 1976 [DE] Fed. Rep. of Germany ..... 2637331

[51] Int. Cl.[2] ..... B07C 5/04

[52] U.S. Cl. ..... 209/518; 209/558; 209/586; 250/560; 356/398

[58] Field of Search ..... 209/73, 74 R, 74 M, 209/82, 111.7 R, 111.7 T, 75, 517, 518, 586, 558; 250/223 R, 560, 571; 356/156, 157, 167

[56] References Cited

U.S. PATENT DOCUMENTS

| | | | |
|---|---|---|---|
| 3,513,321 | 5/1970 | Sherman | 250/560 |
| 3,669,263 | 6/1972 | Babb | 209/82 |
| 3,680,692 | 8/1972 | Southworth | 209/82 X |
| 3,694,658 | 9/1972 | Watson et al. | 250/560 |
| 4,105,925 | 8/1978 | Rossol et al. | 250/560 X |
| 4,120,403 | 10/1978 | Stephanos | 209/586 X |

*Primary Examiner*—Joseph J. Rolla

*Attorney, Agent, or Firm*—Benoit Law Corporation

[57] ABSTRACT

Disclosed apparatus sort unequally dimensioned veneer sections or other objects which are successively conveyed in a transit direction by a conveyor in parallel to their planes. A series of sensors are mounted at equal mutual distances across the conveyor in a row extending transversely to the transit direction and generate sensor signals in response to successively conveyed objects. The sensor signals are analyzed and the extents of the conveyed objects are tested on the basis of the analyzed sensor signals, preferably with the aid of predetermined nominal values. The conveyed objects are sorted in accordance with their tested extents.

17 Claims, 5 Drawing Figures

| | WIDTH IN TRANSIT DIRECTION | | | |
|---|---|---|---|---|
| LENGTH TRANSVERSE TO TRANSIT DIRECTION | | 33="0" (i.e.34="0") | 33="1" 34="0" | 34="1" (i.e.33="1") |
| | 30="0" (i.e.31="0") | SCRAP 54="1" | SCRAP 54="1" | SCRAP 54="1" |
| | 30="1" 31="0" | SCRAP 54="1" | NOTCH STRIP 53="1" | NOTCH STRIP 53="1" |
| | 31="1" (i.e.30="1") | SCRAP 54="1" | GOOD STRIP 52="1" | HEAVY WIDTH 51="1" |

APPARATUS FOR SORTING OBJECTS

BACKGROUND OF THE INVENTION

1. Field of the Invention

The subject invention relates to sorting systems and, more specifically, to systems and apparatus for sorting veneer sections and other unequal objects.

2. Prior Art

By way of example, the invention is concerned with sorting apparatus for veneer sections and other unequally dimensioned sheet-like objects, having a row of fixedly arranged sensors responding to veneer sections and other objects conveyed on a conveyor or the like in parallel to their plane, and including circuitry for processing the signals of the sensors and at least one switch or distributor for the veneer sections or other objects, located after the sensors in the direction of conveyance and controlled by an output signal of the processing circuitry.

Sorting equipment of the above mentioned type is known from the German Patent Publication No. 1,205,260. In that equipment, a row of sensors arranged longitudinally of a conveyor is employed for determining the dimensions of the veneer sections or objects in the direction of conveyance along a resulting line of measurement.

Such prior-art sorting equipment neglects to take into consideration the shape of the veneer section or other object outside the line of measurement.

SUMMARY OF THE INVENTION

It is a general object of this invention to overcome the above mentioned disadvantages.

It is a germane object of the invention to provide improved sorting systems and apparatus, particularly for unequally dimensioned veneer sections and other sheet-like objects.

It is also an object of this invention to provide equipment for sorting veneer sections and other sheet-like objects which comprehends or analyzes the sections or objects in the sense of sorting criteria beyond or alternative to those satisfied by the prior art and which provides a sorting operation conducive to the further processing of the sections or objects.

From a first aspect thereof, the invention resides in an apparatus for sorting unequally dimensioned sheet-like objects successively conveyed in a transit direction by a conveyor in parallel to their planes, comprising, in combination, a series of sensors for generating sensor signals in response to the successively conveyed objects, means for mounting the sensors at equal mutual distances across the conveyor in a row extending transversely to the transit direction, means for generating pulses indicative of units of travel of the conveyor, means connected to the sensors and the generating means for counting as to each sensor signal the number of pulses occurring during the presence of the particular sensor signal, means connected to said counting means for, and means connected to the analyzing and testing means for sorting conveyed objects in accordance with the tested extents.

From another aspect thereof, the invention resides in an apparatus for sorting unequally dimensioned sheet-like objects successively conveyed in a transit direction by a conveyor in parallel to their planes, comprising, in combination, means including a series of sensors for generating sensor signals in response to the successively conveyed objects, means for mounting the sensors at equal mutual distances across the conveyor in a row extending transversely to the transit direction, means connected to the sensors for analysing the sensor signals and testing the extents of conveyed objects, each sensor an individual memory element for storing sensor signals of the particular sensor and means connected to the memory elements of the sensors for determining the extent of conveyed objects in a direction transverse to the transit direction on the basis of the sensor signals, stored for the memory elements and means connected to the analyzing and testing means for sorting conveyed objects in accordance with the tested extents in the transit and transverse directions.

From a further aspect thereof, the invention resides in apparatus for sorting unequally dimensioned sheet-like objects successively conveyed in a transit direction by a conveyor in parallel to their planes, comprising, in combination, a series of first sensors for generating first sensor signals in response to arrivals of the successively conveyed objects on the conveyor, means including a series of second sensors for generating second sensor signals in response to the successively conveyed objects, means for mounting the second sensors at equal mutual distances across the conveyor and, as seen in transit direction, behind the first series of sensors in a row extending transversely to the transit direction, means connected to the first and second sensors for analyzing the second sensor signals in response to the first sensor signals, including for each of the second sensors an individual memory element for storing sensor signals of the particular second sensor, and means connected to the memory elements of the second sensors for testing the extents of conveyed objects in transit direction on the basis of the stored sensor signals and means connected to the memory elements for determining the number of uninterruptedly adjacent second sensors providing similar sensor signals, and means connected to the determining means for testing the extents of conveyed objects in the direction transverse to the transit direction on the basis of determined numbers of adjacent second sensors providing similar sensor signals, and means connected to the analyzing and testing means for sorting conveyed objects in accordance with the tested extents.

In a preferred embodiment, the sensors are aligned in a row extending transversely to the operating direction of the conveyor and being distributed at equal mutual distances over the entire conveyor belt width, and the processing or analyzing circuitry includes storage or memory elements individually associated with the sensors for a comprehension or analysis of the veneer sections or other objects in the direction of conveyance or transit.

This preferred embodiment thus is capable of sensing or analyzing the conveying veneer section or other object also as to its extent transversely to the direction of transit and to effect a total analysis of the section or object during conveyance in transit direction. The resulting analysis permits the equipment to make a decision about the usability of the veneer section or other object as a whole or as to a particular part, and to control the distributor in such a manner that a sorting operation results which permits due consideration of the subsequent use or appropriately different work processing of the sorted sections or objects.

In an advantageous form of execution, the analyzing and testing circuitry may include integrating elements as storage devices, and also a test circuit which ascertains the number of integrating elements containing signals that exceed a predetermined minimum value and corresponding to sensors which are adjacent in an uninterrupted line. Such a test circuit permits a monitoring of veneer sections or objects for predetermined minimum or nominal dimensions. The integrating elements may be reset to zero and/or blocked if a sensor supplies an error or absence signal in the time between the start and end of a section or object, so that areas which contain defects may be excluded.

The above mentioned test circuit permits a simple monitoring operation to determine, in the case of veneer sections and other objects having mutually parallel, straight cutting edges, the dimensions in the direction of the cutting edges between which an uninterrupted area is present. Apertures or marginal notches in the veneer sections or other objects would bring about an error or absence signal in the sensors encountering these defects and a correspondingly reduced signal in the integrating elements, whereby the test circuit is enabled to determine a limit for the usable area or range.

As a particular advantage, equipment according to a preferred embodiment is not dependent on an exact alignment of the cutting edges transversely to the transit direction, but tolerates certain faulty alignments of the veneer sections and other objects which would be difficult to eliminate in practice, by cancelling out effects of misalignment at the beginning of a section or object through effects of corresponding misalignments at its end.

BRIEF DESCRIPTION OF THE DRAWINGS

Further features and advantages of the invention are apparent from the accompanying claims and the following description, wherein a preferred embodiment of the invention is disclosed in detail in conjunction with drawings, in which:

DESCRIPTION OF PREFERRED EMBODIMENTS

Figure 1:
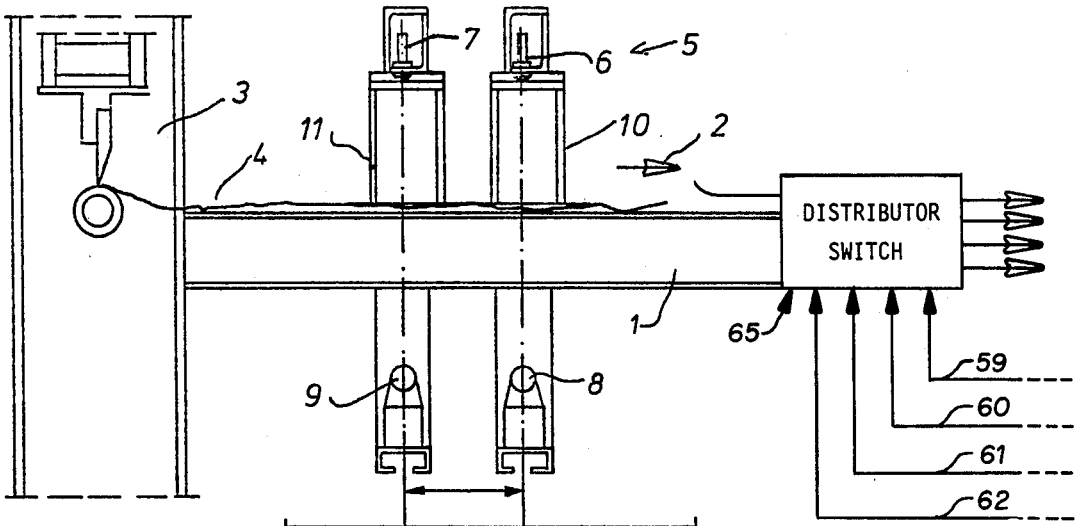
FIG. 1 is a side view of part of a sorting apparatus.

In the partial showing of a sorting apparatus according to FIG. 1, there is seen a lateral beam 1 of a diagrammatically illustrated conveyor, preferably a belt conveyor which, in the direction of conveyance indicated by an arrow 2, is joined to a cutter 3. A veneer cut or section 4 is apparently above the lateral beam 1 of the conveyor. Behind or after the cutter 3 in the direction of conveyance, there is arranged sensing or measuring equipment having photocells 6 and 7, respectively, above the conveyor and light sources 8 and 9, respectively, below the conveyor. The photcells 6 and 7, respectively, constitute sensors which respond to passing veneer sections when these or parts thereof reach a measuring or sensing range directed toward the light sources 8 and 9, respectively. The measuring equipment, in addition to the photocells 6 and light source 8 and the photocells 7 and light source 9, includes a frame 10 and a frame 11, respectively, with suitable mounting structures, light apertures and the like.

Figure 2:
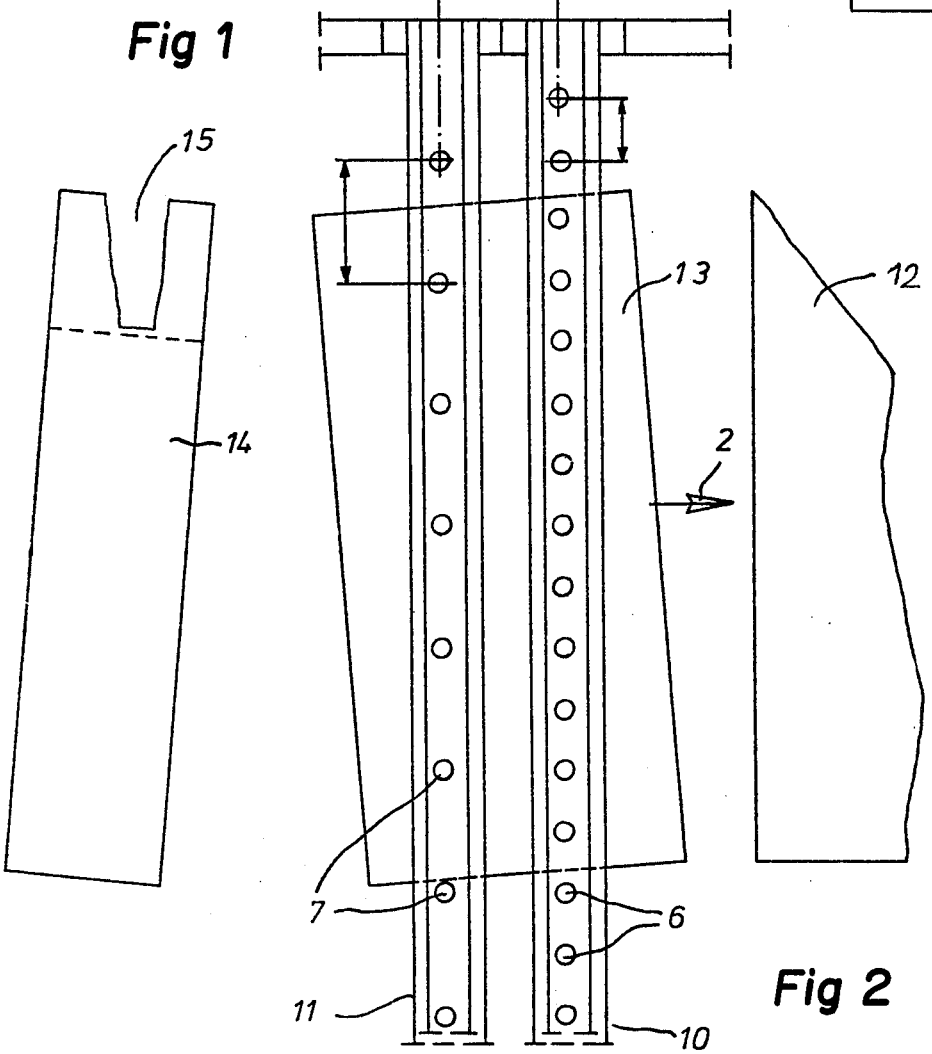
FIG. 2 is a partial top view of a sorting apparatus.

As apparent from FIG. 2, each series of photocells 6 and 7, of which for each series only one photocell is visible in the side view of FIG. 1, has its photocells arranged in a horizontal row transversely to the direction of conveyance of the conveyor 1. For increased clarity the cutter 3 is not shown in FIG. 2. For the same reason, the conveyor 1 is also not shown. Shown, however, are veneer sections 12, 13 and 14 in a shape and position, as they typically pass the sensing equipment 5 on the conveyor 1. Recognizably, the photocells 6 are spaced equally among themselves and the photocells 7 are also equidistant from each other, with the spacing between photocells 7 being considerably larger (e.g. 20 cm) than the spacing between photocells 6 (e.g. 10 cm). The rows or series of photocells extend preferably over the entire width of the conveyor 1.

It is to be understood that the illustrated photocells represent only a preferred type of sensors which, alternatively may, for instance, employ mechanical sensors or feelers, pneumatic sensors or electrical proximity switches.

With the subject measuring apparatus, veneer sections may be sensed or comprehended principally in different respects. Thus, in response to a preliminary signal of one or a predetermined number of photoelements 7 indicating the arrival of a veneer section, the extent of the front or leading edge of the veneer section in transverse direction may be determined with the aid of photoelements 6. The time of travel of the veneer section between the photoelements 7 and 6 is to be taken into consideration by a corresponding time delay. Thereafter, the further travel of the veneer section can be monitored by the photoelement 6, the signal of which is stored in the storage elements or memory of the analyzing circuitry, wherein additional control devices are provided which reset to zero and block the storage elements in response to an absence signal of the associated photoelement. The measurement or sensing process is then continued until the photoelements 7 determine or sense the passing of the trailing or back edge of the veneer section. On the basis of the stored signals, the analyzing equipment is able to determine the number of storage elements of adjacent photoelements 6 which contain a positive signal and, thus, the dimension of the veneer section in transverse direction which is in usable condition. In parallel to this, the dimension of the veneer section in the direction of conveyance may be determined by an integrator following through the measurement duration.

Such an integrator may as an analog element be supplied with a steady input signal, or may be executed as a digital counter which is supplied with a succession of pulses. Different conveyor speeds may be taken account of by controlling the input signal for an analog integrator or the pulse frequency for a digital counter in proportion to the conveyor speed.

Another form of analysis and control is particularly described below, especially with reference to FIG. 3. The basic operation of the analysis and control circuits resides in the integration of the measurement or sensor signals of the photoelements 6 throughout the entire passage of a veneer section. On the basis of the assumption that usable veneer sections during a preceding cutting operation in the cutter 3 have received a front or leading edge and a back or trailing edge which are parallel to each other, the integrating elements of photodiodes which sense a faultless area between parallel front and back edges contain identical signals. This identity of signals also results with a tilted or canted passage of the veneer section; that is, in instances when it is not exactly parallel to the row of photoelements 6.

The analyzing circuitry then determines the integrating elements of adjacent photoelements which contain identical signals in order to ascertain the usable dimension of the veneer section in transverse direction.

For the purpose of illustration, three different veneer section archetypes are represented in FIG. 2 in the form of veneer sections 12, 13 and 14.

The veneer section 12 has no straight front edge, so that the analyzing circuit does not find identical signals in integrating elements of adjacent photoelements. The veneer section 12 is, therefore, sorted out as "scrap".

The veneer section 13 has parallel front and back edges throughout its entire transverse extent and is free of defective or faulty areas therebetween. If one presupposes that the veneer section 13 has a usable dimension in the transit direction, the section 13 may be sorted as a "good strip" or "healthy strip". If the dimension in transit direction exceeds a predetermined size, the veneer section 13 may be sorted out among "heavy-widths".

The veneer section 14 has mutually parallel front and back edges, but has a marginal notch 15 projecting into its area. This veneer section is, therefore, not usable over its transverse extent, but only for a dimension shortened by the depth of the marginal notch 15.

An identical signal of the integrating elements occurs only with respect to the photoelements 6 which do not encounter the marginal notch 15. Correspondingly, the analysis indicates a shortened dimension in the transverse direction, whereupon the veneer section 14 is sorted among "notch-strips".

A corresponding sorting out also occurs in the case of a hole-like defect in the section. This under the assumption that the remaining dimension in transverse direction as also in transit direction surpasses a predetermined minimum size. If this is not the case, the veneer section would be sorted out among "scrap".

For the monitoring operation in transit direction mentioned in connection with the above sorting criteria, the integrating element signal determined as identical with other signals may be employed. However, where an automatic location and analysis of such integrating elements by analyzing circuitry requires a large effort and extensive equipment, especially where there is a large number of integrating elements (and photocells), it is simpler to ascertain the total extent of the veneer section in transit direction with an additional integrating element.

Figure 3:
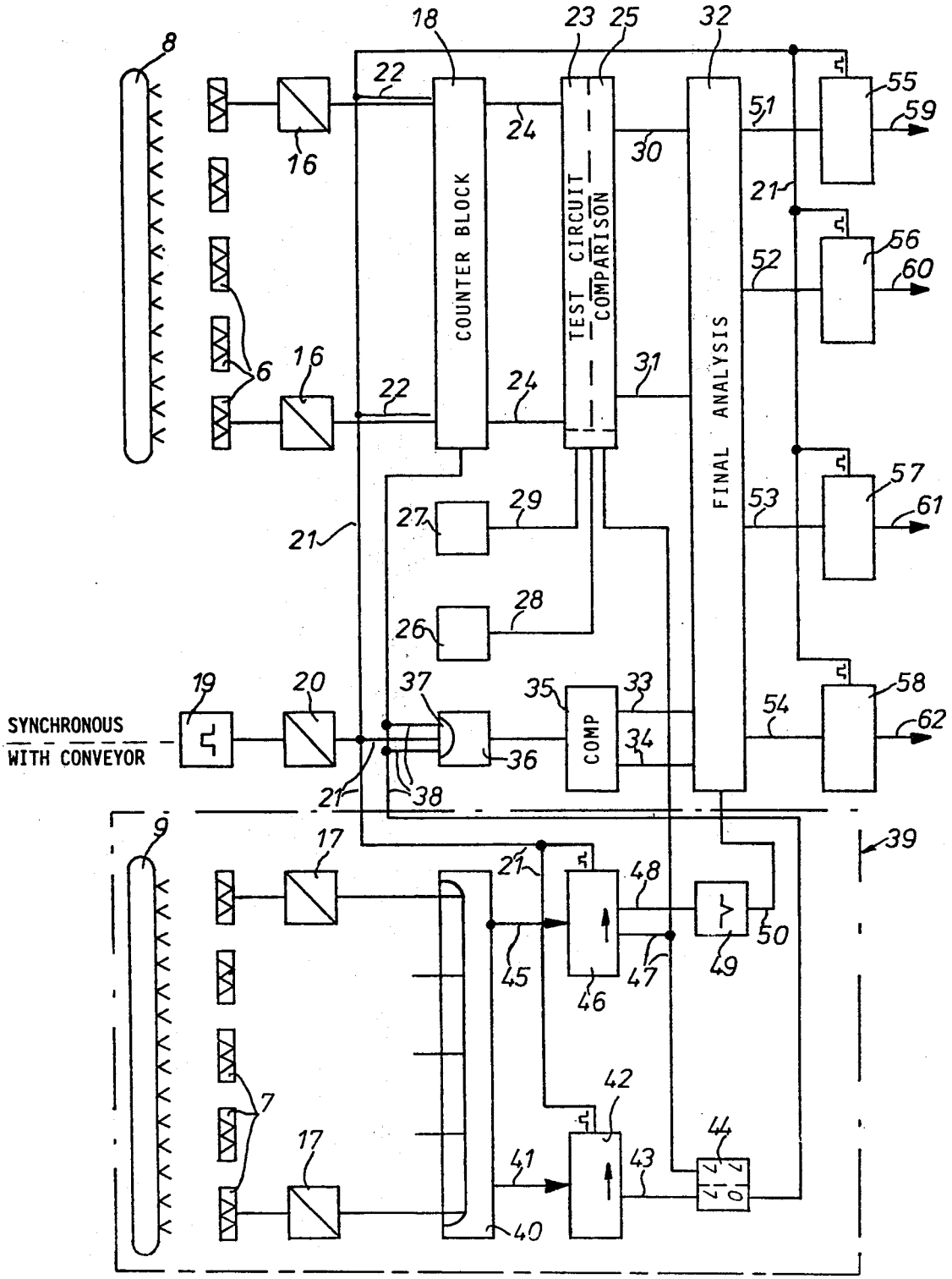
FIG. 3 is a block diagram of the measuring or sensing equipment and the analyzing and control circuitry of the sorting apparatus.

FIG. 3 diagrammatically shows the light sources of lamps 8 and 9, as well as the rows or series of photoelements or cells 6 and 7, respectively. For the sake of simplicity and increased clarity, only part of the photoelements and circuits connected thereto have been shown.

The photoelements 6 and 7, respectively, have trigger circuits 16 and 17 (only two being shown for each set) connected thereto, serving the determination of the photoelement output signals into two defined signal levels for a presence signal and an absence signal, respectively.

The output signals of the trigger circuits 16 are applied to a counter block 18 comprising pulse counters individually allocated to each trigger circuit 16 and therefore to each photoelement 6. The counter block 18 also includes an individual AND gate (not shown) for each pulse counter, connected between a trigger circuit 16 and its associated pulse counter in the block 18. Each of these AND gates has a first input connected to the output of the associated trigger circuit 16, and the second input 22 connected via a common lead 21 and trigger circuit 20 to a pulse generator 19. The output of each of these AND gates is connected to the counting input of the associated pulse counter in the block 18.

According to the operation of the AND gate, counting pulses from the generator 19 reach and step a particular counter in the block 18 only when a presence or sensor signal of the associated photoelement 6 is presented via the particular trigger circuit 16. The pulse generator is coupled to the conveyor so that the pulse frequency is proportional to the conveyor speed. In this manner, the space between two pulses corresponds to a specific unit of travel of the conveyor (e.g. 1 cm) so that the content of the counters corresponds to the extent of the veneer section in transit direction measured by the associated photoelements or, in the case of occurring faults or defects, to the sum of the partial extents (in centimeters).

A test circuit 23 is connected to the counter block 18 via connecting leads only part of which are shown. This test circuit 23 ascertains the number of integrating elements having identical signals and being associated with photoelements 6 that are adjacent in an uninterrupted succession. By way of example, such a test circuit can be formed as a static circuit arrangement in which the signals of integrating elements pertaining to adjacent photocells are compared with each other through gates and wherein the possible combinations are detected through further gates in a succeeding stage and are analyzed into a code signal for the number to be determined by the test circuit.

In an alternatively utilized preferred embodiment of the test circuit, those skilled in the art have at their disposition, for example, a dynamic arrangement in the sense that the digital signals of the pulse counters are fed successively in a corresponding test circuit with the aid of shift registers, whereby the uninterrupted sequence of identical neighboring values is counted.

The test circuit 23 functionally is closely connected to a transverse-direction comparison circuit 25 wherein the number determined in the test circuit is compared to nominal or predetermined required values. These nominal values— equal to two in the present embodiment—are derivable from nominal value memories or storage devices 26 and 27 via connecting leads 28 and 29, respectively. The devices 26 and 27 are reprogrammable as needed for changing nominal value settings.

Obviously, the comparison effected in the cross-direction comparison circuit with two nominal values can lead to three different results. Two output lines 30, 31 are at the disposal of a parallel supply of binary signals; with three combinations of the four possible signal combinations being defined as output signals of the transverse-direction comparison circuit. These three combinations serve as input signals of a final analysis circuit 32.

The final analysis circuit 32 receives additionally via lines 33 and 34 a signal of a transit-direction comparison circuit 35 for an analysis in transit direction. In the transit-direction comparison circuit 35, the signal of an additional pulse counter 36, acting as separate transit-direction integrating element, is compared to predetermined nominal values.

The pulse counter 36 counts via an input AND gate 37 incoming pulses, which are formed in the gate 37 by AND-combination of the pulse signals lead in via the line 21 and a signal on a line 38.

The line 38 is supplied with a signal by preparation or setting circuitry 39 which includes the photoelements 7 and the trigger circuits 77. The output signals of the trigger circuits 17 are combined in an OR gate 40, which issues a switching signal via an output line 41 as soon and as long as only one of the (preparation or setting) photoelements 7 responds (to a veneer section).

The signal issued via line 41 reaches a shift register 42 to which the pulses provided by the pulse generator 19 are supplied as stepping pulses via a branch of the line 21. The output signal of the shift register 42 in a line 43 is delayed relative to the input signal in line 41 by a predetermined number of pulse spacings. This delay takes into account the transit or travel time of the veneer section from the row of photoelements 7 to the low of photoelements 6 and varies with the speed of the conveyor through the coupling of the pulse generator 19 to the conveyor. The signal issued via line 43 sets a storage flip-flop 44 (bistable multivibrator), to the output of which the line 38 leading to the input gate 37 of the counter 36 is connected. The line 38 leads further to the counter block 18, the pulse counters of which are reset to the start of the measurement operation.

The OR gate 40 has a second, inverting output to which there is connected an output line 45 which leads to a second shift register 46. The shift register 46 corresponds in design to the shift register 42 and is also connected to the line 21 for the reception of stepping pulses. The output signal of the shift register 42 is applied via a line 47 to the storage flip-flop 44 on the one hand, in order to reset same, and to the test circuit 23 and the transverse-direction comparison circuit 25 on the other hand, in order to release there the particular analysis operation.

The shift register 46 has a second output equipped with an output line 48 and being additionally delayed relative to the output connected to the line 47. The second output of the shift register 46 leads via the line 48, a pulse shaper 49 and a line 50 to the final analysis circuit 32 in order to release there the final analysis.

The preparation circuitry 39 thus performs essentially preparation and control functions, with the beginning and the end of the total transit or travel of a veneer section being monitored by means of the photoelements 7 and the OR gate 40. The storage flip-flop 44 is set for the duration of the transit, with the shift registers 42 and 66 equalizing the transition-time delays between photoelements 7 and 6. Since the storage flip-flop 44 is set during the entire transit of a veneer section, the counting pulses reach the input gate 37 of the pulse counter 36 during that entire time, whereby the pulse counter 36 takes cognizance of the entire extent of the veneer section. The succeeding transit-direction comparison circuit 35 then determines whether the veneer section with respect to its extent in transit or travel direction and, more particularly measured with respect to two different nominal values, is usable. Out of four possible binary signal combinations in the output lines 33 and 34 of the transit-direction comparison circuit 35, there are again defined three combinations, depending on whether the dimension of the veneer sections is below both nominal values, between the nominal values or above both nominal values.

The final analysis circuit 32 mutually combines the result of the analysis in transverse direction and the measurement or analysis in transit direction. The result of the final analysis is a control signal on one of four output lines 51, 52, 53 and 54. The line 54 is energized if a veneer section falls below the nominal value in one of the directions of measurement; indicating "scrap". The line 53 is energized if the transit-direction comparison circuit 35 indicates that a veneer section exceeds at least the lower nominal value and if pursuant to the analysis by the transverse-direction comparison circuit 25 a dimension lying between the nominal values is determined; indicating a "notch strip". The line 52 is energized if the transit-direction comparison circuit 35 indicates a dimension of the veneer section in transit direction lying between the nominal values and if the transverse-direction comparison by the transverse-direction comparison circuit 25 indicates that the veneer section exceeds both associated nominal values; indicating a "good" or "healthy" strip. The line 51, finally, is energized if in transit direction as well as in transverse direction each of the particular upper nominal values are exceeded; indicating a "heavy width".

The lines 51, 52, 53 and 54 lead to a delay element 55, 56, 57 and 58, respectively, having the form of shift registers.

These shift registers receive their stepping pulses through a further branch of the line 21 and issue via their output lines 59, 60, 61 and 62, respectively, control signals representing signals as they arrive via lines 51, 52, 53 and 54 and being delayed relative to those arriving signals by a predetermined number of pulse spaces.

By virtue of the delays thus providable, it is possible to control switches or other such routing or directing devices of a distributor provided in transit direction behind the measuring or sensor equipment in adaptation to the motion of the particular veneer section on the conveyor. With the synchronized pulse signal of the pulse generator 19, it is even possible to maintain the delay control operative at different conveyor speeds.

Since the signals of the photoelements 7 apart from a time delay are also derivable from the photoelements 6 and since in view of the extremely short switching times of electronic elements no significant preparation times need be provided, the signals received by the OR gate 40 may, in a modified embodiment of the invention, be derived from the trigger circuits 16, in which case there merely is to be provided a correspondingly modified chronological adaptation of the signals fed via lines 38 and 50.

Figures 4, 5:
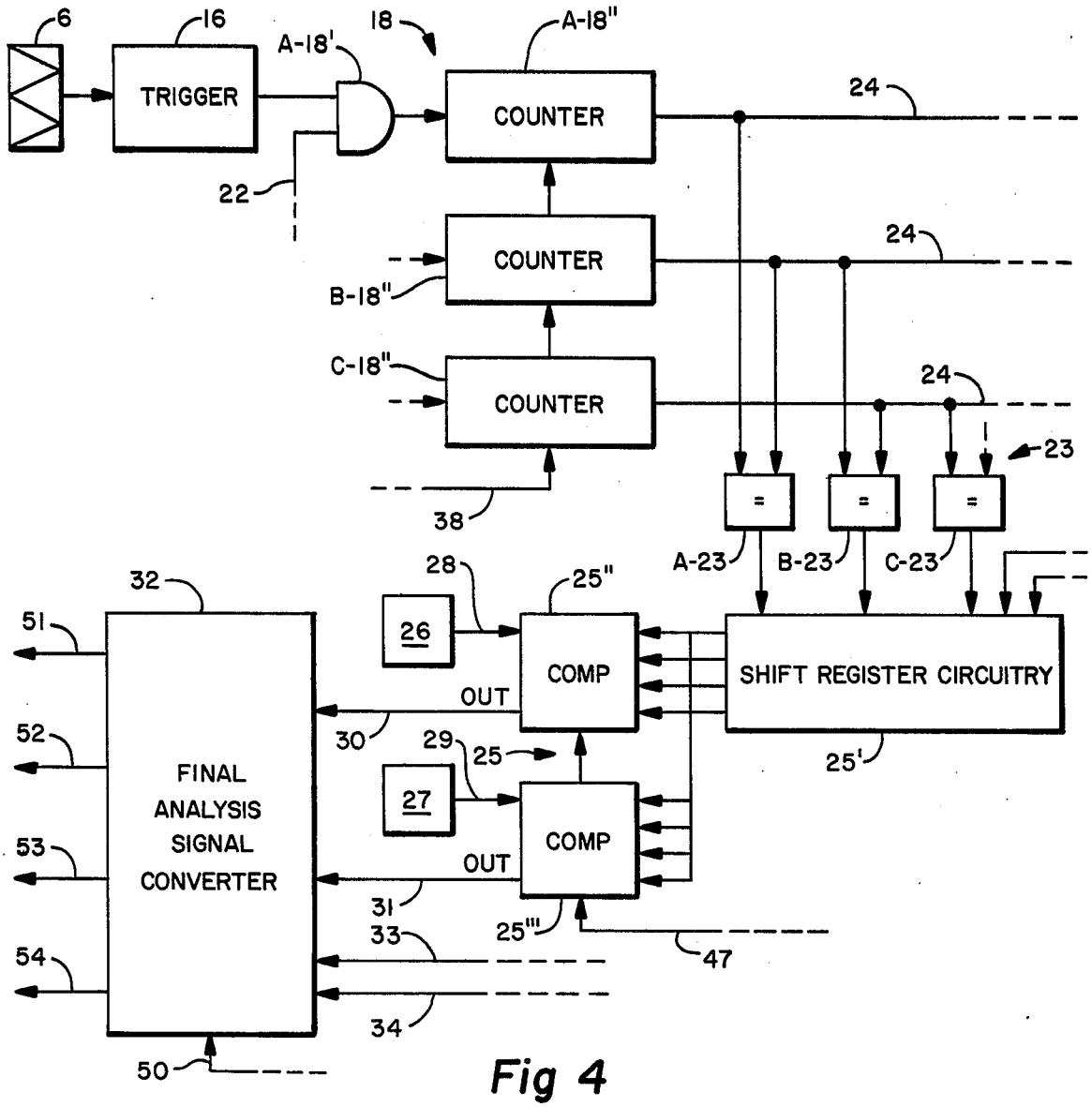
FIG. 4 is a block diagram of circuitry that may be employed in the equipment of FIG. 3.
FIG. 5 is a truth table illustrating the nature and function of the analysis and signal converter circuitry of FIGS. 3 and 4.

Part of the disclosure made above with respect to FIG. 3 is further depicted in FIG. 4. To avoid repetition, FIG. 4 shows only one of the several photoelements 6 and trigger circuits 16.

In FIG. 4, the above mentioned AND gate is shown at A-18′, and, as already explained, receives the synchronous pulse generator signals at an input 22 for interrogating the sensors 6 at discrete intervals and enabling an analysis of the sensor signals in terms of unit of travel of the veneer section travel. Veneer section present signals of the sensor 6 are thus gated by the AND element A-18′ to a counter A-18″ in the counter block 18, where the number of units-of-travel pulses are counted and stored for an analysis of the extent of the veneer section in transit direction.

Additional counters B-18", C-18" et seq. in the counter block 18 receive triggered signals from other photoelements 6 to cover the extent of the veneer section along adjacent lines of measurement.

FIG. 4 also shows the test circuit 23 diagrammatically in its above mentioned static version, employing matching circuits A-23, B-23, C-23 et seq. for comparing outputs of adjacent counters. Each of these matching circuits provides shift register circuitry 25' with a binary "1" when the outputs of its two associated counters A-18", B-18" etc. match, and with a binary "0" when no such match occurs. The shift register circuitry 25' receives the output signals of the matching circuits A-23 etc. in parallel and shifts them out in series, providing a series of digits which indicates, by an uninterrupted sequence of like digits, the width of the corresponding veneer strip over which equal dimensions in transit direction have been sensed. Equivalent logic circuitry may be employed for this purpose.

The transverse-direction comparison circuit 25 further includes a comparator 25" for comparing the above mentioned number determined by the test circuit 23 and shift register circuitry 25' with a first nominal value stored in the programmable memory 26, and a comparator 25''' for comparing the above mentioned number with a second nominal value stored in the programmable memory 27, in order to produce in the lines 30 and 31 the parallel binary signals "0" and "1" defining the transverse dimension or extent of the portion of the tested veneer strip having uniform quality. These signals are received by the final analysis circuit 32 which also receives the above mentioned signals via lines 33 and 34 as an indication of the dimension or extent of the tested veneer strip in transit direction.

The truth table of FIG. 5 illustrates the nature and function of the final analysis circuit 32 in terms of the binary signals occurring in lines 30, 31, 33, 34. In the illustrated preferred embodiment, the circuit 32 provides a binary "1" in a selected one of the lines 51 to 54 (selected on the basis of the signals in lines 30, 31, 33, 34) and a binary "0" in each of the remaining lines. In this manner, a binary "1" in line 51 indicates a "heavy width" strip, a binary "1" in line 52 a "good" or "healthy" strip, a binary "1" in line 53 a "notch strip" (see 14, 15 in FIG. 2), and a binary "1" in line 54 an unusable strip ("scrap"). The final analysis circuit 32 may be implemented in practice by various conventional logic circuitry at the discretion of the circuit designer and on the basis of the truth table of FIG. 5, as customary in logic circuit design.

As indicated in FIG. 1, the output signals of the final analysis circuit 32, upon passage through shift registers or delay elements 55 to 58 (FIG. 3) and lines 59 to 62, energize a veneer section distributor switch or sorter, diagrammatically indicated in FIG. 1, with reference to FIG. 3, as an electromechanically actuated mechanical sorter 65. In practice, the sorter may be composed of several two-way distributor switches in series or by one or more multi-level switches, as desired.

Variations and modifications within the spirit and scope of the subject invention will be apparent to those skilled in the art from the subject extensive disclosure.

I claim:

1. An apparatus for sorting unequally dimensioned sheet-like objects successively conveyed in a transit direction by a conveyor in parallel to their planes, comprising in combination:

a series of sensors for generating sensor signals in response to said successively conveyed objects;

means for mounting the sensors at equal mutual distances across the conveyor in a row extending transversely to the transit direction;

means for generating pulses indicative of units of travel of the conveyor;

means connected to said sensors and said generating means for counting as to each sensor signal the number of pulses occurring during the presence of the particular sensor signal;

means connected to said counting means for testing the extents of conveyed objects in transit direction on the basis of pulses counted by said counting means; and means connected to said analyzing and testing means for sorting conveyed objects in accordance with said tested extents.

2. An apparatus as claimed in claim 1, wherein:

said apparatus includes means connected to said counting means for testing the extents of conveyed objects in a direction transverse to the transit direction on the basis of said counted pulses; and said sorting means include means for sorting conveyed objects in accordance with said tested extents in transit direction and said tested extents in a direction transverse to the transit direction.

3. An apparatus as claimed in claim 1, wherein:

said apparatus includes means for analyzing said sensor signals in terms of a predetermined nominal value for testing the extents of conveyed objects in transit direction.

4. An apparatus as claimed in claim 1, wherein:

said counting means include means for interrogating the sensors at discrete intervals and for storing sensor signals provided by interrogated sensors, and said testing means include means for testing the extents of conveyed objects on the basis of stored sensor signals.

5. An apparatus as claimed in claim 1, wherein:

said counting means include means for interrogating the sensors at discrete intervals synchronized with the speed of said conveyor and for storing sensor signals provided by interrogated sensors, and said testing means include means for testing the extents of conveyed objects on the basis of stored sensor signals.

6. An apparatus as claimed in claim 1, including:

means including time delay means connected to said testing means and to said sorting means for adapting the operation of the sorting means to the motion of a particular object.

7. An apparatus as claimed in claim 1, wherein:

said apparatus includes means connected to said counting means for determining the number of uninterruptedly adjacent sensors providing similar sensor signals, and means connected to said determining means for testing the extents of conveyed objects in said transverse direction on the basis of determined numbers of adjacent sensors providing similar sensor signals; and said sorting means include means for sorting conveyed objects in accordance with said tested extents in transit direction and said tested extents in a direction transverse to the transit direction.

8. An apparatus as claimed in claim 7, wherein:

said apparatus includes means connected to said determining means for comparing said determined number with a predetermined nominal value for testing the extents of conveyed objects in transverse direction.

9. An apparatus for sorting unequally dimensioned sheet-like objects successively conveyed in a transit direction by a conveyor in parallel to their planes, comprising in combination:

means including a series of sensors for generating sensor signals in response to said successively conveyed objects;

means for mounting the sensors at equal mutual distances across the conveyor in a row extending transversely to the transit direction;

means connected to said sensors for analyzing said sensor signals and testing the extents of conveyed objects, including for each sensor an individual memory element for storing sensor signals of the particular sensor and means connected to the memory elements of said sensors for determining the extent of conveyed objects in the transit direction and in a direction transverse to the transit direction on the basis of the sensor signals stored by said memory elements; and means connected to said analyzing and testing means for sorting conveyed objects in accordance with said tested extents in said transit and transverse directions.

10. An apparatus as claimed in claim 9, including:

means including time delay means connected to said analyzing and testing means and to said sorting means for adapting the operation of the sorting means to the motion of a particular object.

11. An apparatus as claimed in claim 9, wherein said analyzing and testing means include:

means connected to said memory elements for determining the number of uninterruptedly adjacent sensors providing similar sensor signals; and means connected to said determining means for testing the extents of conveyed objects in said transverse direction on the basis of determined numbers of adjacent sensors providing similar sensor signals.

12. An apparatus as claimed in claim 11, wherein:

said analyzing and testing means include means for comparing said determined number with a predetermined nominal value for testing the extents of conveyed objects in transverse direction.

13. An apparatus as claimed in claim 11, wherein:

said analyzing and testing means include means connected to said memory elements for operating said memory elements at discrete intervals synchronized with the speed of said conveyor to store said sensor signals, and means for testing the extents of conveyed objects in said transit direction on the basis of stored sensor signals.

14. An apparatus for sorting unequally dimensioned sheet-like objects successively conveyed in a transit direction by a conveyor in parallel to their planes, comprising in combination:

a series of first sensors for generating first sensor signals in response to arrivals of said successively conveyed objects on said conveyor;

means including a series of second sensors for generating second sensor signals in response to said successively conveyed objects;

means for mounting the second sensors at equal mutual distances across the conveyor and, as seen in transit direction, behind said first series of sensors in a row extending transversely to the transit direction.

means connected to said first and second sensors for analyzing said second sensor signals in response to said first sensor signals, including for each of said second sensors an individual memory element for storing sensor signals of the particular second sensor, and means connected to the memory elements of said second sensors for testing the extents of conveyed objects in transit direction on the basis of said stored sensor signals and means connected to said memory elements for determining the number of uninterruptedly adjacent second sensors providing similar sensor signals, and means connected to said determining means for testing the extents of conveyed objects in said direction transverse to the transit direction on the basis of determined numbers of adjacent second sensors providing similar sensor signals; and means connected to said analyzing and testing means for sorting conveyed objects in accordance with said tested extents.

15. An apparatus as claimed in claim 14, including:

means for mounting the first sensors at equal mutual distances larger than the distances at which the second sensors are mounted.

16. An apparatus as claimed in claim 14, wherein:

the analyzing and determining means include means for generating pulses indicative of units of travel of the conveyor;

said memory elements include for each second sensor means connected to the particular second sensor and to the pulse generating means for counting as to each second sensor signal the number of pulses occurring during the presence of the particular second sensor signal;

the analyzing and determining means further include means connected to the first sensors and to the counting means for controlling the operation of the counting means in response to first sensor signals; and the testing means include means connected to said counting means for testing the extents of conveyed objects in transit direction on the basis of pulses counted by said counting means.

17. An apparatus as claimed in claim 14, wherein:

the analyzing and determining means include means for generating pulses indicative of units of travel of the conveyor;

the analyzing and determining means further include means connected to the first sensors for monitoring the beginning and the end of transit of each conveyed object with the aid of first sensor signals;

said memory elements include for each second sensor means connected to the particular second sensor, to the pulse generating means and to the monitoring means for counting during the transit of each conveyed object as to each second sensor signal the number of pulses occurring during the presence of the particular second sensor signal; and means connected to said counting means for testing the extents of conveyed objects in transit direction on the basis of pulses counted by said counting means.

* * * * *